United States Patent [19]

Colea

[11] Patent Number: 4,927,686

[45] Date of Patent: May 22, 1990

[54] COLBAR ART

[75] Inventor: Ovidiu Colea, Glen Cover, N.Y.

[73] Assignee: Colbar Art, Inc., Long Island City, N.Y.

[21] Appl. No.: 288,033

[22] Filed: Dec. 20, 1988

Related U.S. Application Data

[63] Continuation-in-part of Ser. No. 152,161, Feb. 4, 1988, abandoned.

[51] Int. Cl.[5] ..... B44C 3/06

[52] U.S. Cl. ..... 428/13; 156/245; 428/67

[58] Field of Search ..... 428/13, 15, 67; 156/245

[56] References Cited

U.S. PATENT DOCUMENTS

| | | | |
|---|---|---|---|
| 2,451,913 | 10/1948 | Brice | 429/13 X |
| 3,488,246 | 1/1970 | Duggins | 428/15 |
| 3,518,146 | 6/1970 | Plympton | 156/245 |
| 3,796,622 | 3/1974 | Brody | 156/245 |
| 3,944,691 | 3/1976 | Smith | 428/13 |
| 4,089,922 | 5/1978 | Saito et al. | 428/13 X |
| 4,180,930 | 1/1980 | DiMatteo | 428/13 X |
| 4,347,270 | 8/1982 | Hart | 428/13 |
| 4,584,212 | 4/1986 | Klein et al. | 428/13 |
| 4,643,693 | 2/1987 | Rubinstein | 428/13 X |

*Primary Examiner*—Henry F. Epstein
*Attorney, Agent, or Firm*—Bauer & Schaffer

[57] ABSTRACT

An article is produced, having an inner shaped body embedded within an outer shaped body. The inner and outer bodies are formed of a base material moldable into a unitary integrally formed transparent mass. At least the base material forming the inner body has admixed within it finely ground nonsoluble matter rendering the base material at least in part translucent. As a result, the article exhibits three-dimensional regions clearly visible when viewed through the outer body.

17 Claims, 1 Drawing Sheet

COLBAR ART

RELATED APPLICATION

This Continuation-In-Part of U.S. Ser. No. 152,161, filed Feb. 4, 1988 and now abandoned.

FIELD OF THE INVENTION

The present invention relates generally to unitary integrally formed decorative artifacts of the type wherein a decorative three-dimensional body appears embedded within an outer body of transparent material, and particularly to the method for forming such artifacts. Specifically, it relates to the type of artifact wherein the apparent embodied object is characterized by translucent properties, providing an enhanced three-dimensional character.

DESCRIPTION OF THE PRIOR ART

There are many examples of objects embedded within transparent material to enhance their decorative aspects. Natural or manufactured objects such as rocks or coins have commonly been embedded within transparent materials such as plastic, glass, resin, or acrylic. The embedded objects in such devices tend to be characterized by solid and/or opaque visual aspects and lack a realistic three-dimensional character.

An object shaped from transparent material can also be embedded within a body of identical material. However, the object will remain invisible within the body and thereby be void of any artistic or decorative effect. Attempts to enhance the inner body, by rendering the shaped interface between the two elements visible in selected regions have been made. Such attempts applied a topical coloring agent such as paint to one or the other interface surface so that the interior object was coated to thereby rendered the interface visually identifiable. This prior art technique is illustrated by Hart, U.S. Pat. No. 4,347,270.

In such a device, however, the visual and decorative effects of the interior body are limited to the results produced by the conditioning of the interface between the interior object and the body. The interior object remains characterized by its inherent transparency and is not endowed with any other internal qualities which could contribute to or in themselves constitute visual and decorative effects. Furthermore, while the transparent body presents one or more surfaces through which the embedded object may be viewed, the surfaces of the body are not utilized to enhance the illumination or dimensional character of the embedded object or the interior of the body itself. Above all, it is virtually impossible to provide the interior shaped body with realistic shading, variation in color, or three-dimensional attributes by providing a topical paint which is inherently opaque.

It is a further disadvantage of the prior art processes that a truly unitary integral structure cannot be made, in that the paint or material applied to the interface, between the interior and exterior bodies, acts to prevent such bodies from chemically bonding to thereby effectively remove the interface. As a result, the artifacts have an inherent weakness at their interface which may allow the cracking of the bodies after some time and/or under changeable atmospheric conditions.

Another problem and disadvantage of the prior art artifacts lies in the inability to support the interior body within the exterior body during the process of embedment so that, of necessity, supporting elements for the interior body itself are required which supporting elements extend to the exterior surface and have an exterior surface common with that of the outer or exterior body.

The primary object of the present invention is to overcome the shortcomings of prior art processes by providing a decorative article wherein a shaped body of material with inherent translucent properties is embedded within a mass of transparent material.

A further object according to the present invention is to provide a decorative article wherein the surface configuration of the transparent mass influences the passage and internal reflection of light to render visible and illuminate the embedded object and the interior of the mass as desired.

Still further, an object of the present invention is to provide a decorative artifact comprising a translucent body unitary and integrally embedded with an exterior body in which the bodies are physically and chemically bonded so that the interface between the interior and exterior surfaces is invisible.

Yet another object of the present invention resides in providing a body within a body in which the embeddment is complete and no common exterior surface exists, rendering the interior body as appearing self-supporting within the exterior body.

The foregoing advantages and objects together wit h other objects and advantages will be apparent from the following disclosure.

SUMMARY OF THE INVENTION

According to the present invention, an ornamental article is produced, having an inner shaped body embedded within an outer shaped body. The inner and outer bodies are formed of a base material moldable into a unitary integrally formed transparent mass. At least the base material forming the inner body has admixed within it finely ground nonsoluble matter rendering the base material at least in part translucent. As a result, the article exhibits three-dimensional regions clearly visible when viewed through the outer body.

Preferably, the base material for both the inner body and the outer body are of the same homogeneous uniform composition such as a polymer like methylmethacrylate. Thus, the bodies may be molded separately, partially cured, and thereafter unitarily joined and completely cured to a hardened glass-like composition in which the interfaces or joint lines are amorphous and to all intents nonexistent. In this manner, the inner body itself may be shaped into any desired ornamental sculptured object, preferably of a highly decorative and artistic nature, from a base material provided with a small amount of translucent matter, and embedded within the outer transparent body so as to be completely visible in three-dimensional form from all sides or aspects.

Preferably, the translucent matter is selected from precious metals, stones, or the like, or other nonsoluble particulate matter capable of reflecting or refracting light, in a prism-like manner, to provide color or hue to the object.

The present invention also provides a method for embedding an inner body within an outer body so that the inner body is completely surrounded and has the appearance of floating within the outer body. Accordingly, the method provides for first molding an inner body of a base material moldable material into which a relatively small amount of powdered or particulate nonsoluble light reflecting material is admixed. The inner body is thereafter cured at least partially so that one is able to handle it and work it as by polishing, cutting,.etc. Subsequently, the thus prepared inner body is mounted within a partial molding conforming in part to the corresponding part of the outer body while being supported exteriorly of the outer body mold, and the outer body is then molded in situ about the inner body. Thereafter the inner body and the partial outer body are removed, cleaned, and polished, and the remainder of the outer body is molded about the inner body, while the entire mass is supported outside the body mold.

While this process requires several molds of different sizes and shapes and a rather lengthly period for curing, the result provides inner and outer bodies which appear as a single integral unit without interfaces, supports, common exterior surfaces, and the like which are decided advantages.

Full details of the present invention are set forth in the following description and illustrated in the accompanying drawings.

BRIEF DESCRIPTION OF THE DRAWINGS

IN THE DRAWINGS

Figure 1:
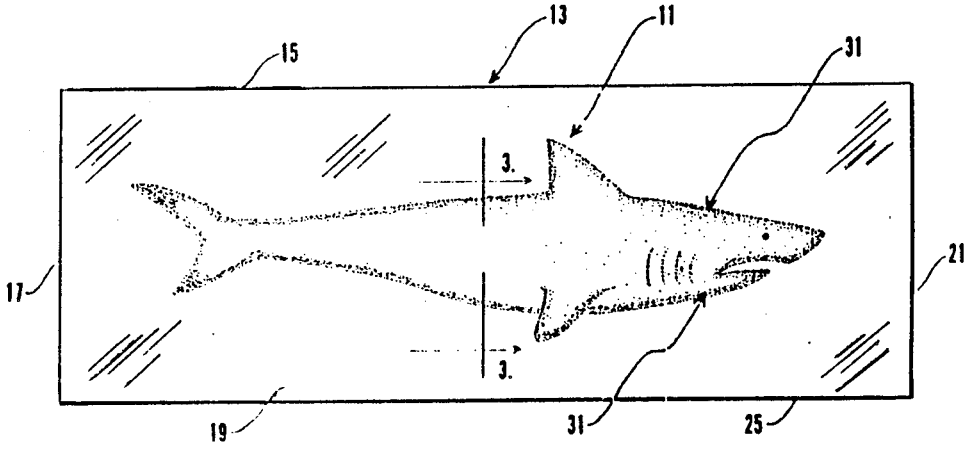
Figure 2:
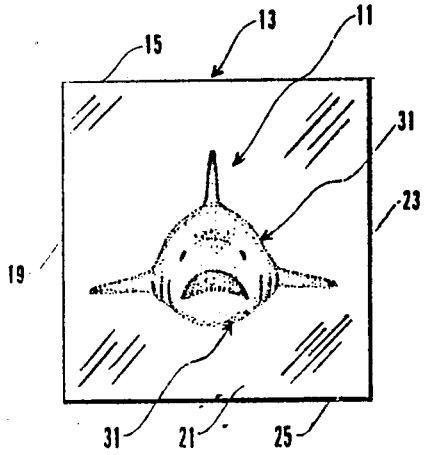

FIG. 1 is a front elevational view of a decorative article constructed according to the present invention;

FIG. 2 is a side elevational view of the article shown in FIG. 1; and

Figure 3:
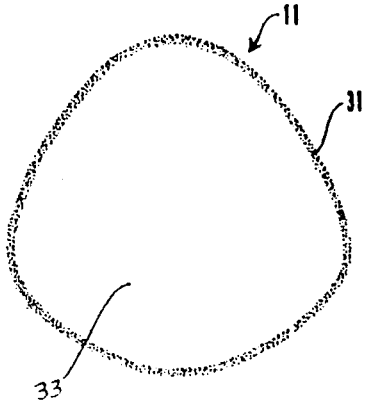

FIG. 3 is a three-fold enlargement of a cross-sectional view of the embedded object taken along section 3—3 of FIG. 1.

DETAILED DESCRIPTION OF THE PREFERRED EMBODIMENTS

Turning now descriptively to the drawings, similar reference characters denote similar elements throughout the several views illustrated in FIGS. 1, 2, and 3. In the particular embodiment of the invention illustrated in the drawings a shaped body 11 of inherently translucent material is embedded within an oblong exterior block of transparent material 13. The body 11 is preferably shaped as a three-dimensional sculpture of inherent decorative, artistic, or other ornamental nature, the nature of the shape, of course, being dictated by the artist, purchaser, etc. The plane surfaces 15, 17, 19, 21, 23, and 25 of the outer body enable the shape of the inner body to be viewed through the transparent mass and influence the illumination of the body 11 and the interior of the block 13. Of course, the outer surfaces may be other than planar to suit the design of the artifact. It too may be a sculptural object.

Briefly, the shaped object 11 is first made, preferably by casting material with inherent translucent properties in a first mold. When the material solidifies sufficiently but yet is not fully cured, the object 11 is positioned in another but larger mold forming the shape of the transparent exterior mass 13. Transparent material is cast about the object 11 within the mold cavity. The second casting of transparent material forms the outer body 13 which sets chemically and bonds with the interior body 11 during the cure period. Both bodies 11 and 13 eventually cure to form a solid, unified, decorative entity.

The base material from which the inner body 11 and the outer body 13 are formed is preferably the same or of identical chemical properties so as to ensure identical characteristics of light transmission, reflection, refraction, cohesiveness, chemical bonding, expansion, and the like. Preferably, the base material is a plastic resin, acrylic resin, or the like, and is capable of curing into the desired hard, fully transparent glass-like body. Methylmethacrylate or similar acrylic materials are most suitable since when polymerized and cured they are perfectly clear and transparent and take on a hardness equivalent to almost that of a glass. In practice a monomer such as DuPont methylmethacrylate monomer H112 mixed with DuPont polymer F4 at a ratio of one (1) part monomer to one and a half (1½) parts polymer, produce most satisfactory results. Other monomer/polymer products such as under TM LUCITE produced by the DuPont Company can be used as well as monomers and polymers produced by the American Hydron Company in New Brunswick, NJ, or others. Such monomers and polymers are mixed and used as taught by the manufacturer, without any modification.

Translucence is created, utilizing the transparent base material used for the inner and/or outer bodies and adding thereto minute amount of microscopic powder or particles of light-reflecting, inorganic, natural, and/or synthetic matter. The particulate matter may be chosen from any suitable opaque material which is nonsoluble and which will remain in dispersion within the polymeric base material, not withstanding its small powdery size. Preferably, the matter are minerals such as stone or metals such as, for example, gold, silver or malachite, which are ground to a fine powder of between 100–500 mesh (sieve size), i.e. powder of between 0.005 and 0.002 millimeters. The particles are thus in the nature of a flour or very fine powder and not particulates, although retaining their opacity and nonsolubility. The opaque material may be ground in any conventional manner, and since only small quantities of such opaque flow are added to the polymer mixtures, a mortar and pestle may be conveniently used.

In addition to the materials suggested earlier, particulate matter (and resultant translucent color) may be obtained from onyx (grey), ferrous oxide (gray), chrusocolla argon (gree), rose quartz (pink), red opal (red), copper (copper), amethyst (silver), etc.

The polymer base material and the opaque particulate or flour matter are mixed together by hand or by blender to form a homogeneous dispersion of the translucent matter in the base material. A ratio of approximately one to three grams of opaque material to one gallon of the polymeric material has been found to be satisfactory for most artifacts. Of course, slight modification may be made to the ratio of opaque to polymeric material so as to vary the translucent density and/or color. Thus, up to eight glasses per gallon may be employed—.

As the material solidifies, the opaque particles become fixed in suspension and an effect is created similar to that of frosted glass, in that the body is partially transparent, letting light pass therethrough but reflecting and diffusing it so that objects on the other side are not clearly defined. The presence of light-reflecting particles in the body 11 renders the body visible and colorful and not only defines the external three dimensions of the body 11 within the block 13, but also creates a visible, inner dimensionality within the body 11, emphasizing the body structure, limb, folds, etc., depending upon such selected factors as the thickness of the body along the sight lines and the folds, contours, etc. for the body shape. In the preferred embodiment of the invention, opposing surface contours are translucently visible through areas on the surface of the body 11 since the small dispersion of opaque matter maintains the base material sufficiently transparent to render the entire body visible in three dimensions. The opaque matter produces not only a translucency but also a color hue or tinge to the base material. Therefore, the proportions of opaque matter to base material may be selected to satisfy the particular intent required from the artifact.

The translucent qualities of the sculptured body 11 represent a specific permutation of two variables. Firstly, the density of the translucent matter in the body is variable. The higher the concentration of particles in suspension, the greater the tendency towards opacity. Conversely, the lower the concentration, the greater the tendency towards transparency. Thus, effects ranging from the almost invisible, fine mist of a very low concentration to the nearly solid-appearing dense fog of a very high concentration can be achieved. In the embodiment illustrated in the drawing, the translucence of body 11 approximates a low concentration of microscopic light-reflecting particles.

The artifacts as illustrated, for example, in FIGS. 1 and 2 are made employing the following process:

The monomer and polymer components (i.e. one (1) part DuPont H/12 and one and one half (1½) parts polymer F4) were mixed and stirred gently by hand until a homogeneous solution was obtained. This homogeneous mixture constitutes the base material, and a quantity of several gallons is made at once. Particulate or opaque matter derived from mica, ground to a fine grain of 0.005 mm, was slowly added to a portion of the base material and admixed therewith a ratio of one gram to one gallon and manually mixed to form a uniform dispersion.

The dispersion of translucent material and base material was then poured into a first mold of suitable and desired shape (i.e. as illustrated in the shape of a fish). The mold is a conventional silicon mold, prelined with silicon so as to provide a suitable release for the polymer after it gels. The dispersion of translucent material and base material is left in the mold for approximately four to six hours under a pressure of between 60–100 psi at ambient temperature. During this time, the polymer, partially cured, forms a gel in which voids or bubbles are absent due to the length of time under pressure without added heat.

Although the object is not fully cured into its final hard, glass-like form, it is sufficiently gelled so as to be manually handled and polished. At this gelled condition removal of pressure does not cause expansion, and the mold shape retains almost the same dimension as in the mold.

The object forming the interior body is then placed in a larger second mold, conforming to the shape of the outer body. Preferably, the outer mold is only a partial mold, conforming to a part of the shape of the outer body not inserted in the mold so that a portion of the translucent inner body can be supported or hung by means exterior of the outer mold, thus eliminating unsightly supports in the outer mold. The partial outer mold is then filled with transparent base material, and the process for curing monomer/polymer mixture is repeated as in the case of forming the translucent inner body, above, repeating the time, temperature, and pressure parameters as set forth above. If a partial outer mold is used initially, a second partial mold conforming to the remainder of the outside body is then prepared, and the inner body or object is placed in that mold, the body being supported by the partially completed section only. Prior thereto, however, the supporting means previously supporting the inner body in the initial partial mold are removed, and the inner body is shaped for completion in the second half of the outer mold. The remainder of the outer body is then molded and completed under the steps described earlier.

While still in the outer mold, temperature is increased up to 150 degrees Farenheit, at a ramp speed of three to four hours and stablized at this temperature, for an additional eight to ten hours. Maintenance of the 60–100 psi pressure is continued to resist bubbling.

Thereafter, external heat is removed, and the object formed is allowed to cool down, by removing external heat, for four to six hours within the mold, under pressure, which also avoids bubbling. Thereafter, the object is removed from the mold and polished.

By heating and curing both the inner object and the outer object together, joining is assured of the faces between them so that any "interface" is eliminated, separation is prevented, and the rate of expansion or reduction due to heating and cooling are identical for both pieces.

Because the curing steps are undertaken over a lengthy period of many hours and under pressure and in part under elevated temperature, the monomer/-polymer mixtures fuse and bond both physically and chemically to each other so that the interface between the inner object and the parts of the outer object, each separately molded, becomes indistinguishable, and the resultant object is unitarily and integrally formed.

The outer body, made of the transparent base material, is absolutely clear and with only minor distortion. The inner object, containing the base material into which the opaque particulate matter has been admixed, results in a three-dimensional object having depth, variations in density, variations in color as well as variations in reflectivity, thereby providing an enormously lifelike object. On the other hand, the outer mold may be sculptured in an ornamental or artistic design. The base material forming the outer body may be in whole or in part translucent, and it may be sanded or worked as well as polished so that, in effect, a sculptured object is embedded within a sculptured object.

In the embodiment shown in FIG. 3 the artifact is made of a two part inner body—namely, a central core 33 of transparent base material and a surrounding layer 31 of translucent base polymeric material. The translucent layer 31 is preferably of at least 2–3 mm in depth and is applied as a polymer mixture of the base material having dispersed therein the opaque matter. This embodiment provides a second variable, influencing the translucent quality of element 11. This variable, i.e. the depth to which the properties of translucence are distributed onto the surface contours of the body 11, provides other characteristics to the finished artifact.

To accomplish this disposition a layer of dispersed translucent base material is applied on the surface of the mold for forming the inner body 11 and allowed to solidify sufficiently before the remainder of the inner shaped body is formed by filling the mold cavity with the transparent base material—that is, base material without the microscopic particles admixed with it. In this defined case, such opaque particles are not included in the base material, which realizes its aforesaid characteristic of solidifying into a transparent substance. As a result, the inner body is formed of the central core 33, exhibiting transparent qualities and a surrounding layer 31 of translucent material. In the process of solidifying the transparent core, it bonds with the outer layer of translucent material to form a single entity therewith. The visual effect of the limited depth of the translucent layer is the creation of internal variation, in that the interface cf the layer of particles and the transparent core defines internal surface forms.

The transparent core contained within the translucent surface layer enhances the internal dispersion of light and the visibility of the aforesaid internal surface forms. To the extent that the relative size of the translucent core is reduced and the thickness of the layer particles increased, so will the visual effects tend toward the previously described uniformity of a completely homogeneously internal translucence. In the present embodiment of the invention it is evident, particularly in FIG. 3 of the drawings, while the the object 11 exhibits a limited depth of translucence when viewed in cross-section; but, when viewed from the exterior, the depth of translucence extends through the entire inner body. Reference character 31 indicates a relatively thin layer of light-reflecting particles extending from the surface of element 11 down into element 11 and enclosing the transparent core 33. In the inner body, here core 33 and layer 31, is integrally bonded together, and when embedded in an outer body the layer 31 and the outer, exterior body 13 is also bonded together, thus ensuring unity and integrity of the artifact.

Given the variability of the density and depth of the translucence of the body 11, numerous permutations of these qualities are possible. Numerous further ranges of translucent effects can be achieved by the utilization of other variables such as selective particles of given coloring and sizing and of selected light-reflectivity or the consistency of the mixture of light-reflecting particles and base material.

Variations of internal translucence can be illustrated by embodiments other than those specifically illustrated. In one such embodiment a layer of translucent material of a particular density may be applied onto the mold surface for the embedded object. Once this has solidified sufficiently, another layer of a different density, color, or grain size is applied onto the first. The remaining mold cavity is then filled with transparent material. In other embodiments selected areas only of the mold surface or preceding layers might be treated with translucent material, another with different qualities laid on top of this and then still more layers on top of these to create a series of transverse layers with varying properties of translucence.

In any event the basic concept involves the creation of a shaped body endowed with inherent translucent properties which is embedded within a transparent mass of the nature described below to form therewith a decorative device.

In the preferred form of the invention the transparent outer body 13 is made from the transparent base material used to form the inner body 11 to factilitate the physical and chemical as well as the visual bonding of the two elements. The transparent mass of the outer body 13, embedding the shaped object 11 is configured with surfaces which influence the passage of light into and out of the mass as well as the reflection of light therein to affect the visibility and illumination of the internal object and the interior of the mass itself. The surfaces of the mass may be discriminately or indiscriminately conditioned and shaped to affect the passage of light. For instance, a surface can be roughened to reduce the passage of light or highly polished to maximize such passage. Similarly, a surface can be shaped o angled to guide or reflect light in a particular direction. In the selected embodiment the block 13 is bounded by plane surfaces 15, 17, 19, 21, 23, and 25. These have been finished to a high polish to afford the maximum visibility into the block and to reflect light inwardly in the manner of the facets of a gemstone.

An infinite range of configurations of block 13 is possible. The outer body or transparent mass could be of an irregular shape composed of facets of different shapes and sizes combined with convex or concave areas. In another embodiment, areas of the surface may be clear and polished while others are treated to reduce or prevent the passage of light therethrough by means such as sandblasting. The choice of means will reflect the artists intentions in terms of visibility and illumination of the transparent mass and embedded body.

Various modifications, changes, and embodiments have been disclosed herein. Others will be obvious to those skilled in the art. Accordingly, it is to be understood that the foregoing disclosure is illustrative only and not limiting of the invention.

What is claimed is:

1. An ornamental article comprising an inner shaped body embedded within an outer shaped body, said inner and outer body being formed of a base material moldable into a unitary, integrally formed transparent mass with amorphous interfaces, at least the base material of said inner body having homogenously suspended in said material, a minute amount of finely ground nonsoluble matter sufficient only to render said base material at least in part translucent and to provide the article with three-dimensional regions visible when viewed through the outer body.

2. The ornamental article according to claim 1 wherein said base material comprises a colorless, homogeneous synthetic resin which hardens into a clear, glass-like mass.

3. The ornamental article according to claim 2 wherein said resin is a polymeric mixture of methylmethacrylate.

4. The ornamental article according to claim 1 wherein said nonsoluble matter is ground from inorganic material.

5. The ornamental article according to claim 4 wherein said inorganic material is selected from the group consisting of noble metal, precious metal, and precious and semiprecious stones.

6. The ornamental article according to claim 4 wherein the ratio of said ground nonsoluble matter to said base material is in the range of 1 to 8 grams per gallon.

7. The ornamental article according to claim 1 wherein said inner body comprises a central core of transparent base material surrounded by a layer of translucent base material.

8. The ornamental article according to claim 1 wherein said shaped inner body is a three-dimensional sculpture.

9. The ornamental article according to claim 1 wherein said shaped outer body is a three-dimensional sculpture.

10. A method for making an ornamental article comprising the steps of molding a three-dimensional object from a transparent base material which self-hardens and which contains a small amount of homogeneously dispersed translucent particles and casting the object of the additional mass of such transparent base material whereby when the same hardens it interacts with the exterior surface of the molded object, giving rise to an amorphous interface therebetween.

11. The method according to claim 10 including the step of making the base material from resinous material.

12. The method according to claim 10 including the step of making translucent matter of material selected from the group consisting of noble metal, precious metal, and precious and semiprecious stones.

13. The method according to claim 12 making the translucent matter as a powder having a size of 100–500 mesh.

14. The method according to claim 13 including a step of mixing said translucencey matter and said base material in a ratio of one to eight grams per gallon.

15. The method according to claim 10 including the step of molding said object in a closed mold for a period of time and under a pressure sufficient to partially harden said base material without bubbles.

16. The method according to claim 15, including the step of subsequently continuing molding under said pressure and for a period of time at an increased temperature.

17. The method according to claim 16, including the step of casting said object in the additional mass under the selected pressure temperature and time.

* * * * *